US005729870A

United States Patent [19]

Sharp

[11] Patent Number: 5,729,870

[45] Date of Patent: Mar. 24, 1998

[54] DETACHABLE FIXING

[76] Inventor: Kenneth Sharp, Odd Fellowvägen 12732, Skärholmen, Sweden

[21] Appl. No.: 783,213

[22] Filed: Jan. 14, 1997

[30] Foreign Application Priority Data

Jan. 17, 1996 [GB] United Kingdom ..... 9600966

[51] Int. Cl.[6] ..... A44B 21/00

[52] U.S. Cl. ..... 24/3.6; 24/67.9; 24/546

[58] Field of Search ..... 24/3.6, 67.9, 546, 24/547, 549, 555, 556, 550, 551, 552, 553, 554

[56] References Cited

U.S. PATENT DOCUMENTS

| | | | |
|---|---|---|---|
| 635,121 | 10/1899 | Bostrom | 24/550 |
| 704,196 | 7/1902 | Ketchin | 24/546 |
| 1,302,067 | 4/1919 | Mendelsohn | 245/3.6 |
| 1,613,390 | 1/1927 | Gillette | 24/3.6 |
| 3,657,909 | 4/1972 | Boswell . | |
| 4,234,998 | 11/1980 | McMickle | 24/3.6 |
| 4,406,074 | 9/1983 | Gallimore . | |
| 4,979,714 | 12/1990 | Russell et al. . | |
| 5,067,205 | 11/1991 | Chen et al. | 24/67.9 |
| 5,465,596 | 11/1995 | Park . | |

FOREIGN PATENT DOCUMENTS

| | | | |
|---|---|---|---|
| 1722887 | 3/1992 | U.S.S.R. | 24/546 |
| 111702 | 5/1916 | United Kingdom . | |
| 219217 | 10/1923 | United Kingdom . | |
| 257989 | 5/1926 | United Kingdom . | |
| 321565 | 11/1928 | United Kingdom . | |

*Primary Examiner*—Victor N. Sakran
*Attorney, Agent, or Firm*—Ratner & Prestia

[57] ABSTRACT

A detachable fixing is formed from a single length of elongate material bent into first and second loop regions. One or both of the loop regions is formed as an elongate loop having a point of entry which is resiliently biased closed by the nature and formation of the material, and has one end of the elongate material disposed to form an exit from the loop.

6 Claims, 4 Drawing Sheets

DETACHABLE FIXING

FIELD OF THE INVENTION

This invention relates to a detachable fixing for securing one article to another in such a way that attachment and detachment are simple, but the fixing is secure in use.

One example of the application of the invention is in attaching one or more keys to an article of clothing.

BACKGROUND TO THE INVENTION

There is a wide variety of prior art key rings, including a number having fixings for attachment to clothing. Such known fixings however, can only be secured to belt latches or attachment loops, and in consequence their usefulness is limited. Furthermore, they are relatively complicated and expensive to manufacture.

SUMMARY OF THE INVENTION

Accordingly, an object of the invention is to provide an improved form of detachable fixing which is simple and cheap to manufacture.

Another object of the invention is to provide an improved form of key ring fixing which can be attached to and detached from a variety of parts of items of clothing, in a simple secure manner.

The present invention provides a detachable fixing which is formed from a single length of elongate material which is bent to form a first loop region and a second loop region. At least one of said regions is an elongate loop having first and second side portions and first and second end portions, the side portions being long with respect to the end portions. The elongate loop is formed such that one of the loop end portions coacts with an adjacent portion of the elongate material to define a resilient entry.

The elongate material is preferably spring steel wire of about 2 mm diameter.

The two loop regions may be identical, the fixing being symmetrical.

DESCRIPTION OF PREFERRED EMBODIMENTS

Embodiments of the invention will now be described, by way of example only, with reference to the drawings, in which.

Figure 6A:
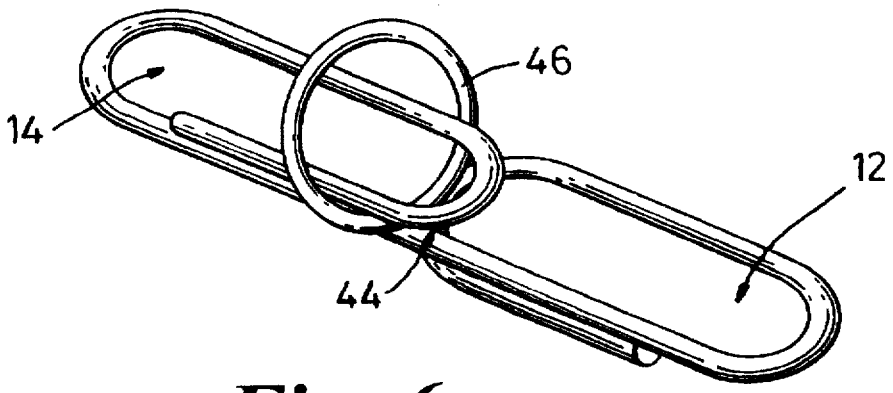
Figure 6B:
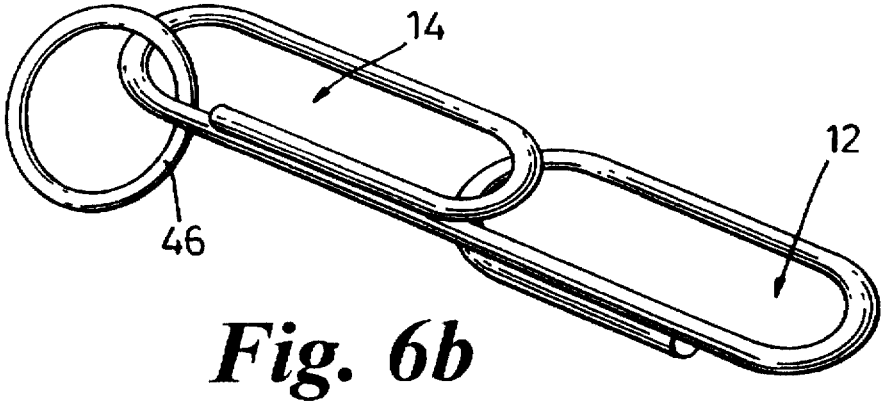
Figure 7:
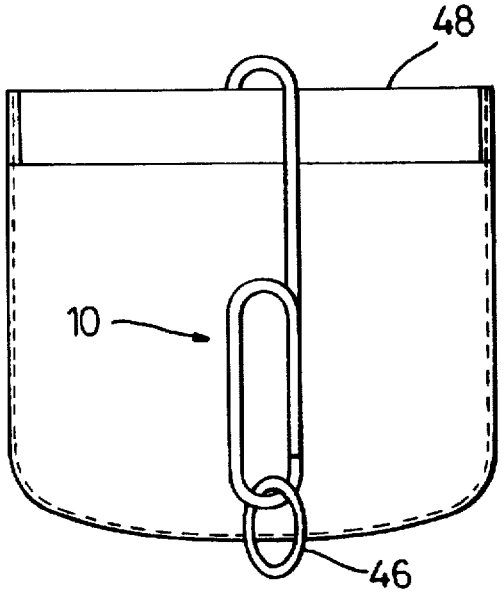
Figure 8:
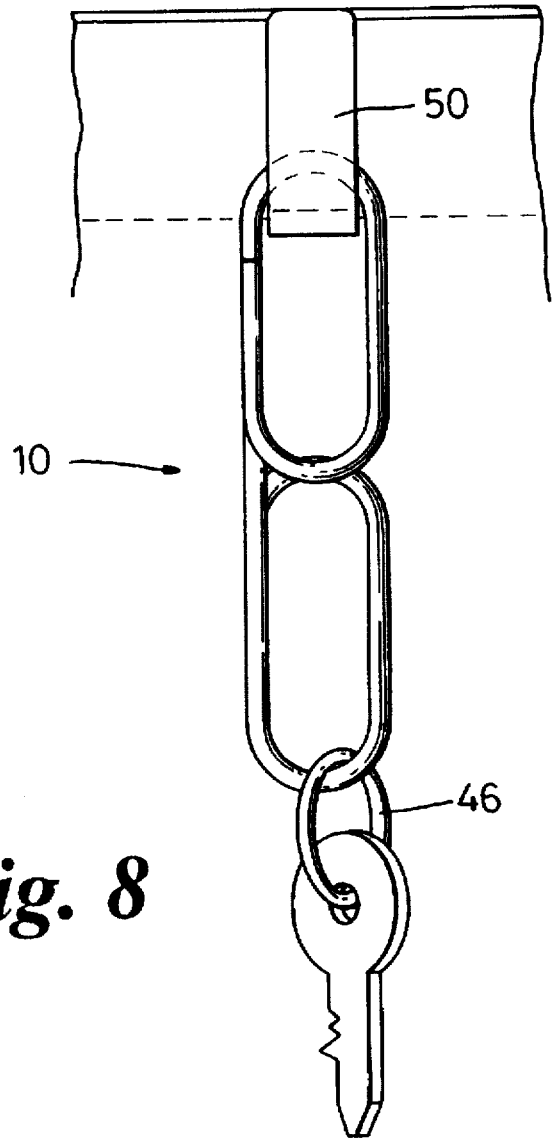
Figure 9:
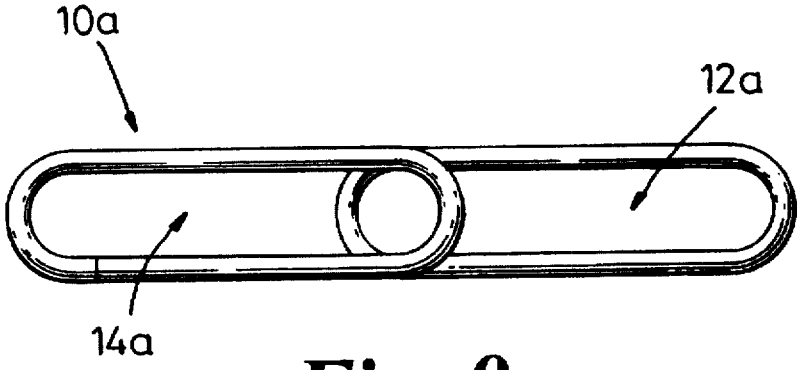

FIG. 6*a* shows a ring being connected with the fixing of FIGS. 1 to 5;

FIG. 6 shows the arrangement of FIG. 6*a* with the ring secured;

FIG. 7 illustrates the fixing attached to a belt loop;

FIG. 8 shows the fixing attached to a shirt pocket;

FIG. 9 is a plan view of a modification of the foregoing embodiment; and

Figure 10:
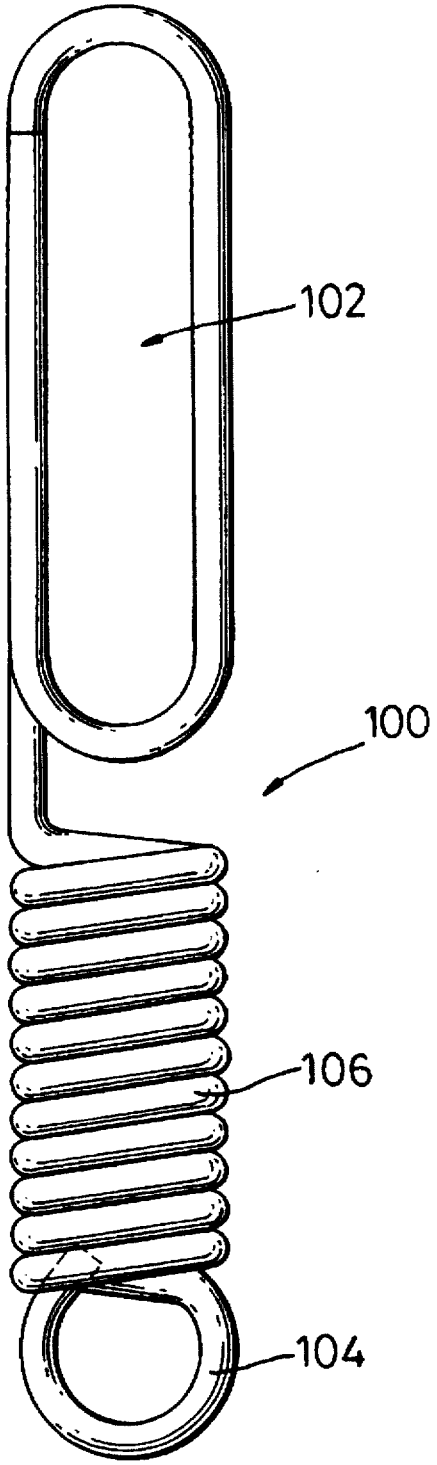
Figure 11:
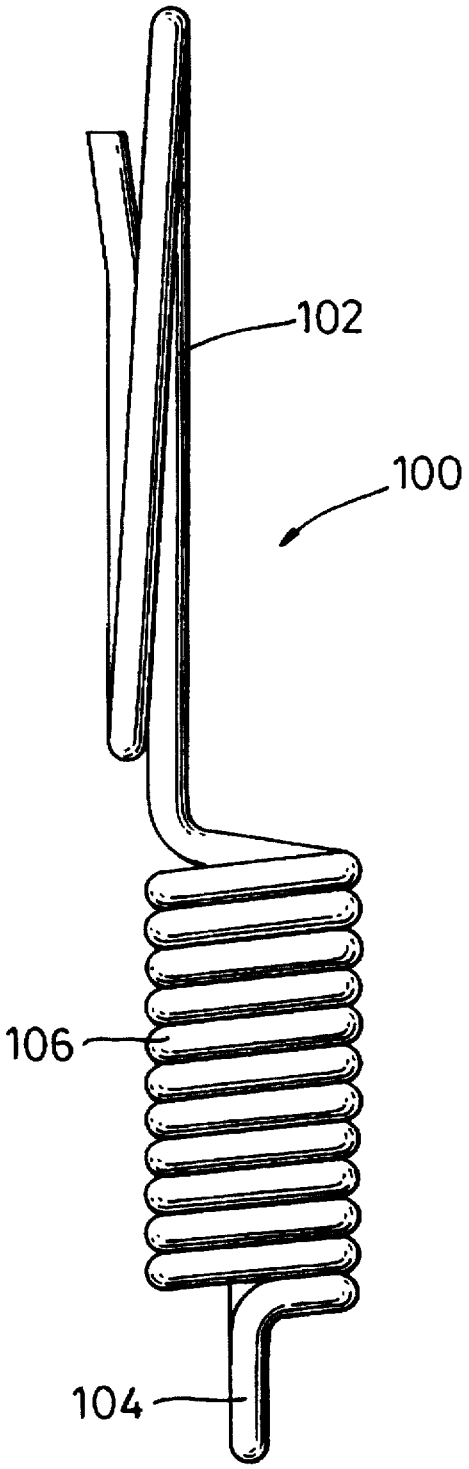

FIGS. 10 and 11 are front and side views, respectively, of a further embodiment.

Referring to FIGS. 1 to 5, the first embodiment of the invention is in the form of a detachable fixing 10 which is formed by bending a single length of spring steel wire of 2 mm diameter, to form a first loop 12 and a second loop 14 joined by an intermediate part 16.

The intermediate part 16 forms the centre of a straight length of wire which also provides an elongate side portion 18, 20 for the loops 12, 14 respectively. Each of the loops 12, 14 has a second elongate side portion 22, 24 and end portions 26, 28, 30, 32. Each of the loops 12, 14 also comprises a further length of wire, 34, 36 overlying the first elongate and terminating in an end 38, 40 of the length of wire.

Figure 3:
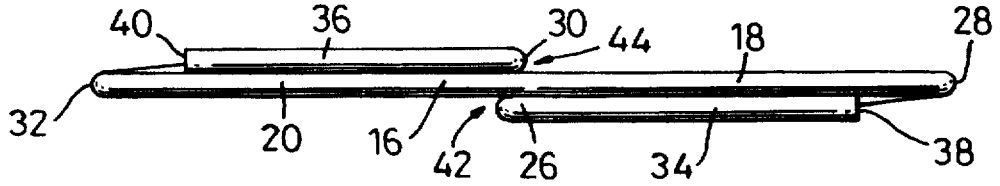
FIG. 3 is a view of the fixing from one side.
Figure 4:
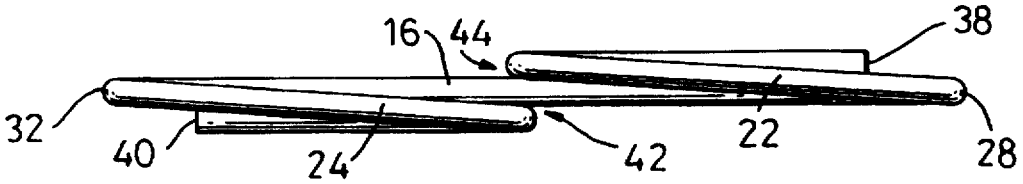
FIG. 4 is a view of the fixing from the other side.
Figure 5:
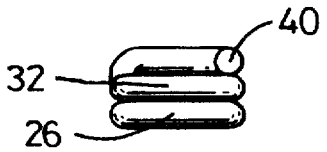
FIG. 5 is an end view of the same fixing.

As will been seen particularly from FIGS. 3 and 4, this structure has the effect that each of the loops 12, 14 is provided with a point of entry 42, 44 between an end portion 26, 30 and the intermediate part 16. The entry 42, 44 provides a means by which an object, such as the ring 46 seen in FIG. 6, can be inserted in a simple manner to become engaged within the loop.

Since the entry 42, 44 is resiliently biased closed and since the adjacent sections of wire such as 20 and 34 exert an inward gripping action, the fixing 10 may be securely attached to a thin planar material. As one example, FIG. 7 shows the fixing 10 secured to the edge 48 of a shirt pocket.

FIG. 8 shows the fixing 10 secured to a belt loop 50.

In this way, the fixing 10 may readily be used to secure one or more keys to the users clothing.

Objects such as rings or keys can equally readily be removed from the fixing by sliding around the wire and off at the appropriate end 38 or 40.

Figure 1:
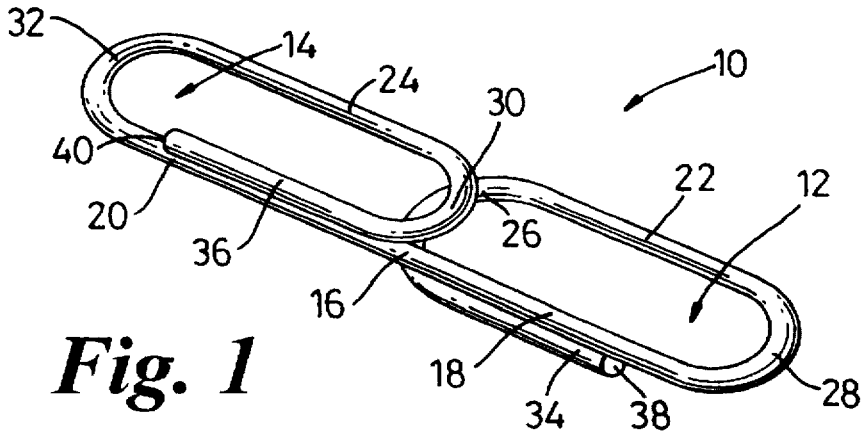
FIG. 1 is a perspective view of a detachable fixing forming one embodiment of the present invention.
Figure 2:
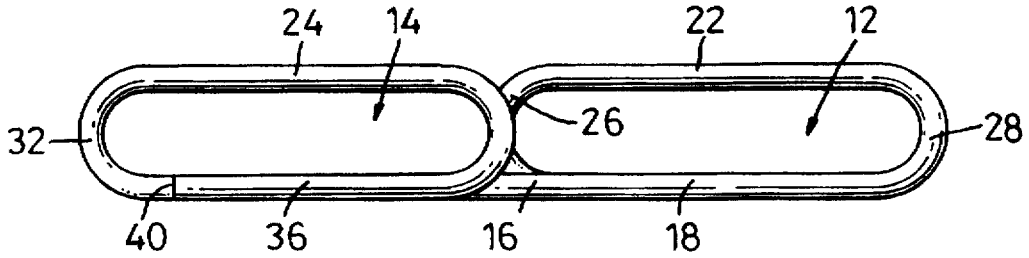
FIG. 2 is a plan view of the fixing of FIG. 1.

The fixing of the first embodiment has two loops of equal size, conveniently about 40 mm by 10 mm each, and is symmetrical. As best seen in FIGS. 2 to 4, the fixing 10 of the first embodiment has the inner ends of the loops 12 and 14 adjacent. FIG. 9 shows a modified embodiment in which a fixing 10*a* has loops 12*a* and 14*a* similar to the foregoing, but with the inner ends overlapped.

FIGS. 10 and 11 show a further embodiment in which a detachable fixing 100 has a single loop 102 of similar form to one end of the fixings as described above, the loop 102 being joined to a ring 104 by a helical section 106 which acts as a resilient spring.

Although described above with particular reference to use as a key ring, the detachable fixing of the present invention may be used for other applications. For example, it may be used to secure a leash to a dog collar, or to secure a handle or strap to a bag.

Modifications may be made to the foregoing embodiments within the scope of the present invention as defined in the appended Claims. As one example, the overlapping part of the elongate loop could be made with two sections of the elongate material side by side in the plane of the loop, rather than superimposed transverse to the plane of the loop; in this case, the end portion could be bent up slightly to facilitate entry.

I claim:

1. A detachable fixing comprising a single length of elongate material having first and second ends, said single length being formed into a first loop region and a second loop region;

at least the first loop region being formed as an elongate loop defining first and second side portions, closed by first and second end portions said side portions being long in relation to said end portions;

said first end of the elongate member being positioned on one of said long side portions immediately adjacent an intermediate part of said elongate member;

said intermediate part of the elongate member extending to interconnect said first and second loop regions;

and said first end portion being displaced relative to said intermediate part in a direction transverse to the plane of the first loop, to form a point of entry for engagement of the first loop member with another object.

2. A detachable fixing according to claim 1, in which the second loop region is formed as an elongate loop defining first and second side portions closed by first and second end portions, said side portions being long in relation to said end portions;

said second end of the elongate member being positioned on one of said long side portions immediately adjacent said intermediate part of said elongate member;

and said second end portion being displaced relative to said intermediate part in a direction transverse to the plane of the second loop, to form a point of entry for engagement of the second loop member with another object.

3. A detachable fixing according to claim 2, in which said intermediate portion is straight, the first and second loop regions are generally coplanar, the first end portion of the first loop region is above the intermediate part, and the first end portion of the second loop region is below the intermediate part.

4. A detachable fixing according to claim 3, in which said first end portions of said first and second loop regions substantially overlie each other.

5. A detachable fixing according to claim 3, in which said first and second loop regions are partially overlapped such that the first end portion of the first loop region lies above the interior of the second loop region, and the first end portion of the second loop region lies below the interior of the first loop region.

6. A detachable fixing according to claim 1, in which the second loop region is substantially circular, and said intermediate portion includes a helix of said elongate material which acts as a flexible spring.

* * * * *